US010724784B2

(12) United States Patent
Lv et al.

(10) Patent No.: US 10,724,784 B2
(45) Date of Patent: Jul. 28, 2020

(54) HOUSEHOLD APPLIANCE

(71) Applicant: BSH HAUSGERAETE GMBH, Munich (DE)

(72) Inventors: Ping Lv, Nanjing (CN); Chuan Zhang, Chuzhou (CN); Yaoguo Xu, Nanjing (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/856,286

(22) Filed: Dec. 28, 2017

(65) Prior Publication Data

US 2018/0187953 A1 Jul. 5, 2018

(30) Foreign Application Priority Data

Dec. 29, 2016 (CN) ..... 2016 1 1253871

(51) Int. Cl.

| | |
|---|---|
| ***F25D 23/02*** | (2006.01) |
| ***E05D 11/00*** | (2006.01) |
| *A47F 3/04* | (2006.01) |
| *A47F 3/00* | (2006.01) |

(52) U.S. Cl.

CPC ..... *F25D 23/028* (2013.01); *E05D 11/0054* (2013.01); *F25D 23/025* (2013.01); *A47F 3/005* (2013.01); *A47F 3/0434* (2013.01); *E05Y 2900/31* (2013.01); *F25D 2323/023* (2013.01)

(58) Field of Classification Search

CPC ..... F25D 23/02; F25D 23/025; F25D 23/028; E05D 11/0054

USPC ..... 312/401, 405, 405.1, 326

See application file for complete search history.

(56) References Cited

U.S. PATENT DOCUMENTS

| | | | | |
|---|---|---|---|---|
| 5,048,233 | A * | 9/1991 | Gidseg | E06B 3/78 126/198 |
| 2006/0273700 | A1 | 12/2006 | Gomoll et al. | |
| 2007/0062226 | A1 | 3/2007 | Gomoll et al. | |
| 2013/0026900 | A1* | 1/2013 | Oh | E05D 11/0081 312/401 |
| 2014/0132142 | A1* | 5/2014 | Kim | F25D 23/028 312/405 |
| 2014/0132146 | A1* | 5/2014 | Kim | F25D 23/025 312/405.1 |
| 2015/0260443 | A1* | 9/2015 | Lee | F25D 23/02 312/404 |

(Continued)

FOREIGN PATENT DOCUMENTS

| | | | |
|---|---|---|---|
| CN | 204535247 | * | 8/2015 |
| EP | 3086061 | A1 | 10/2016 |

(Continued)

*Primary Examiner* — James O Hansen

(74) *Attorney, Agent, or Firm* — Laurence A. Greenberg; Werner H. Stemer; Ralph E. Locher

(57) ABSTRACT

A household appliance has a case body and a door that is pivotable about a rotation axis relative to the case body. The door includes a doorframe and a front door panel connected to a front side of the doorframe. The front door panel includes a protruding portion that extends out of the doorframe along a length or width direction of the door, and the door further includes a cover member disposed behind the protruding portion. The structure of the door is thus more diversified, to ensure a function of the door, and at the same time, meet an appearance requirement of industrial design.

22 Claims, 4 Drawing Sheets

(56) References Cited

U.S. PATENT DOCUMENTS

2017/0211874 A1 7/2017 Kim et al.

FOREIGN PATENT DOCUMENTS

WO 2004105558 A1 12/2004
WO 2004106823 A1 12/2004

* cited by examiner

HOUSEHOLD APPLIANCE

CROSS-REFERENCE TO RELATED APPLICATION

This application claims the benefit, under 35 U.S.C. § 119, of Chinese patent application CN 201611253871.X, filed Dec. 29, 2016; the prior application is herewith incorporated by reference in its entirety.

BACKGROUND OF THE INVENTION

Technical Field

The present invention relates to a household appliance.

In a household appliance (such as a refrigerator), its storage space may be closed by using a single-layer door, or may be closed by using a double-layer door that includes an inner door and an outer door. The double-layer door includes the inner door connected to a case body and the outer door connected to the inner door. Rotatable connections respectively exist between the outer door and the inner door and between the inner door and the case body. A structure of the outer door and a connection structure between the outer door and the inner door affect the appearance of the household appliance.

BRIEF SUMMARY OF THE INVENTION

The present invention provides an improved household appliance, to resolve at least one of the foregoing technical problems.

With the foregoing and other objects in view there is provided, in accordance with the invention, a household appliance, comprising:

a case body and a door rotatably mounted about a rotation axis relative to said case body;

said door including a doorframe having a front side and a front door panel connected to the front side of said doorframe;

said front door panel having a protruding portion that extends out of said doorframe along a length or width direction of said; and said door having a cover member disposed behind said protruding portion.

In other words, the present invention provides a household appliance with the following elements and features: a case body and a door rotatable around a rotation axis relative to the case body. The door includes a doorframe and a front door panel connected to a front side of the doorframe. The front door panel includes a protruding portion that extends out of the doorframe along a length or width direction of the door, and the door further includes a cover member disposed behind the protruding portion.

Compared with the prior art, the technical solutions of the present invention have the following advantages: The front door panel extends out of the doorframe along the length or width direction and forms the protruding portion. The cover member is disposed behind the protruding portion. On one hand, the cover member can achieve an enhancing effect, to improve the strength of the protruding portion and prevent the protruding portion from breaking. On the other hand, the cover member can achieve a covering effect, to cover some components, such as a hinge and a door handle, in a door structure. Therefore, structures of the door can be more diversified, to ensure their functions, and at the time, meet an appearance requirement of industrial design.

In accordance with an added feature of the invention, the cover member may be fixed on at least one of the front door panel or the doorframe. Preferably, each cover member is connected to both the front door panel and the doorframe. For example, the cover member may be fixed on the doorframe by using a fixing structure, and at the same time, adhere to a rear surface of the front door panel.

In accordance with an additional feature of the invention, the household appliance further includes a hinge for limiting the rotation axis, and the hinge includes a first end disposed on an end surface of the doorframe. The protruding portion extends out of the doorframe along a direction of the rotation axis, the first end of the hinge is located behind the protruding portion, and the cover member shields the first end at least on a side of the hinge towards a door side surface, thereby preventing the first end of the hinge from being exposed on a side corresponding to the door side surface to a visual field of a user, and improving the appearance of the door.

In accordance with a further feature of the invention, the doorframe may include a first door side surface and a second door side surface opposite to each other that are arranged along a direction perpendicular to a length direction of the rotation axis, and the second door side surface is closer to the rotation axis than the first door side surface. The cover member has a first shielding wall towards the hinge, and the first shielding wall is located on a side of the hinge towards the first door side surface. Along a direction from the first door side surface to the second door side surface, the first end of the hinge is shielded by the first shielding wall. Therefore, from the perspective of a free end of the door, the first end of the hinge is shielded by the first shielding wall, to be hidden from the sight of the user.

In some embodiments, the first shielding wall may be formed by the end surface of the cover member. Particularly, for a cover member at the bottom of the door, a probability for the hinge at the bottom to be exposed to the visual field of the user is relatively small, and therefore the first shielding wall may be set only in a corresponding cover member.

The first shielding wall may include two parts connected to each other, one part extends along a thickness direction of the door, and the other part extends along a direction from the first door side surface to the second door side surface.

Preferably, the two parts may have a smooth transition, that is, a connection location between the two parts is round.

In accordance with another feature of the invention, the doorframe may include a first door side surface and a second door side surface opposite to each other that are arranged along a direction perpendicular to a length direction of the rotation axis, and the second door side surface is closer to the rotation axis than the first door side surface. The cover member has a second shielding wall towards the hinge, and the second shielding wall is located on a side of the hinge towards the second door side surface. Along a direction from the second door side surface to the first door side surface, the first end of the hinge is shielded by the second shielding wall. Therefore, from the perspective of a rotation axis of the door, the first end of the hinge is shielded by the second shielding wall, to be hidden from the sight of the user.

The second shielding wall may be flush with the second door side surface, to serve as a part of the second door side surface.

Optionally, the cover member has a third shielding wall towards the hinge, and the third shielding wall is located on a side of the hinge opposite to the doorframe. The third shielding wall is used to shield the first end of the hinge from the perspective of the top of the door. Therefore, from the perspective of the top of the door, the first end of the hinge is hidden behind the third shielding wall.

In accordance with yet an added feature of the invention, the cover member and the protruding portion are flush with each other on a side opposite to the doorframe.

When the door is a door that turns upwards or downwards, a structure of a second cover member and a structure of a first cover member are preferably set to be consistent with each other. Therefore, hinges on both sides can be effectively shielded.

In accordance with yet an additional feature of the invention, the first end of the hinge is fixed to the doorframe. For example, the first end is provided with a hinge shaft, the doorframe is provided with a shaft hole for accommodating the hinge shaft, and the hinge shaft and the shaft hole are coaxial and limit the rotation axis.

In accordance with yet a further feature of the invention, the doorframe includes two door side surfaces located on two sides along a length direction of the protruding portion, and the cover member extends from one of the door side surfaces to the other door side surface.

In accordance with yet another feature of the invention, the cover member is provided with a handle portion; or a handle portion is provided at the back of the protruding portion, and the cover member is located between the handle portion and the protruding portion.

In accordance with again an added feature of the invention, the cover member is a protective plate connected to a rear surface of the protruding portion to shield the rear surface.

In accordance with again another feature of the invention, the doorframe includes at least one border having a heat-insulation cavity inside, and the front door panel is connected to a front side of the border.

In accordance with again an additional feature of the invention, the border is an extrusion member.

In accordance with again a further feature of the invention, the front door panel is a glass plate.

In accordance with a concomitant feature of the invention, the door further includes a heat-insulation glass module, and the doorframe surrounds the heat-insulation glass module.

In some embodiments, the household appliance further includes an inner door rotatably connected to the case body, where the door is rotatable relative to the inner door. When both the inner door and the foregoing door are closed, the two doors are superposed.

Other features which are considered as characteristic for the invention are set forth in the appended claims.

Although the invention is illustrated and described herein as embodied in a household appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION

Figure 1:
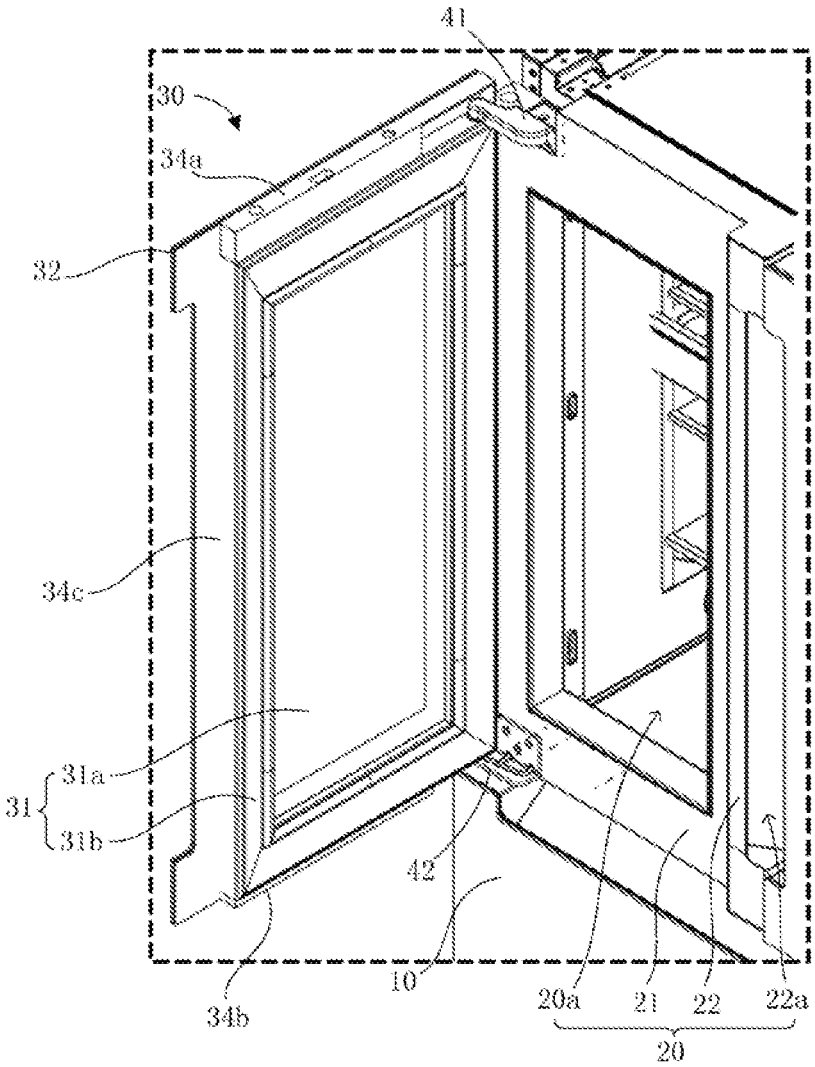
FIG. 1 is a three-dimensional schematic structural diagram of a door structure area of a household appliance according to an embodiment of the present invention.

Referring now to the figures of the drawing in detail and first, particularly, to FIG. 1 thereof, there is shown an exemplary embodiment of a household appliance, here in the form of a refrigerator. The device includes: a case body 10 and a door structure rotatable around a rotation axis relative to the case body 10. The door structure includes an inner door 20 and an outer door 30 that are superposed. The outer door 30 is rotatably disposed before the inner door 20. A storage space is provided inside the inner door 20 to store articles, the storage space has an opening 20*a* towards the outer door 30, and the outer door 30 is used to open or close the opening 20*a*.

The inner door 20 includes a door body 21 surrounding the opening 20*a*, and the door body 21 may be filled with a foaming heat-insulation material. The door body 21 of the inner door 20 is provided with a handle portion 22, and the handle portion 22 is provided with a handle groove 22*a*.

In the present invention, the terms "front" and "back" respectively indicate the front and the back along a front-to-back direction of the door.

In this embodiment, the outer door 30 has a heat-insulation portion 31 for closing the opening 20*a*. The heat-insulation portion 31 includes a heat-insulation glass module 31*a*, a doorframe 31*b* disposed around the heat-insulation glass module 31*a*, and a front door panel 32 disposed before the doorframe 31*b*. The doorframe 31*b* includes several borders (not shown in the figure) that extend along a length direction and a width direction, and the front door panel 32 is connected to front sides of the borders. The borders may be formed by means of a process such as an extrusion process or an injection molding process. Preferably, the border is an extrusion member. In some other embodiments, the heat-insulation portion may alternatively be a foaming door. The front door panel 32 is preferably a glass plate.

Figure 2:
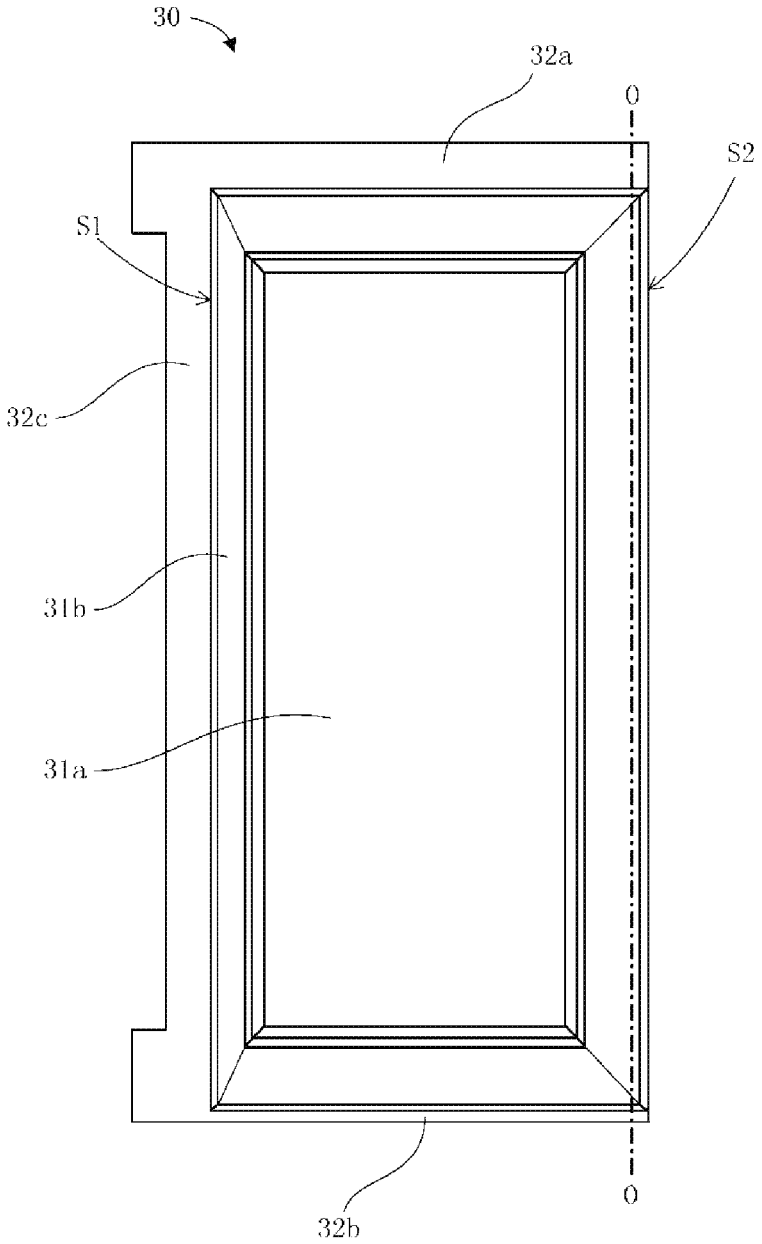
FIG. 2 is a schematic diagram of a main visual structure of an outer door of a household appliance according to an embodiment of the present invention.

Referring to FIG. 2, the front door panel 32 includes protruding portions 32*a*, 32*b*, and 32*c* that extend out of the doorframe 31*b* along the length or width direction, and the outer door 30 further includes cover members 34*a*, 34*b*, and 34*c* disposed on behind the protruding portions 32*a*, 32*b*, and 32*c*. It needs to be noted that, the protruding portions 32*a*, 32*b*, and 32*c* are preferably a part of the front door panel 32. That is, an area of the front door panel 32 is greater than an area of an annular structure enclosed by the doorframe 31*b*. A part of the front door panel 32 that covers the annular structure enclosed by the doorframe 31*b* may serve as a part of the heat-insulation portion 31, and a part of the front door panel 32 that extends out of the doorframe 31*b* forms the protruding portions 32*a*, 32*b*, and 32*c*.

In this embodiment, the protruding portions 32*a*, 32*b*, and 32*c* include a first protruding portion 32*a* and a second protruding portion 32*b* that extend out of two ends of the doorframe 31*b* along a length direction (a height direction of the door in FIG. 1) of a rotation axis 00 of the outer door, and a third protruding portion 32*c* that extends along a direction (a width direction of the door in FIG. 1) away from the rotation axis. A cover member is disposed behind each protruding portion. As shown in FIG. 1. The cover members 34*a*, 34*b*, and 34*c* include a first cover member 34*a* disposed behind the first protruding portion 32*a*, a second cover member 34*b* disposed behind the second protruding portion 32*b*, and a third cover member 34*c* disposed behind the third protruding portion 32*c*.

Each of the cover members 34*a*, 34*b*, and 34*c* is fixed on at least one of the front door panel 32 or the doorframe 31*b*. Preferably, each of the cover members 34*a*, 34*b*, and 34*c* is connected to both the front door panel 32 and the doorframe 31*b*. For example, the cover member may be fixed on the doorframe by using a fixing structure, and at the same time, adhere to a rear surface of the front door panel.

The first cover member 34*a* and the second cover member 34*b* are disposed at two ends of the outer door 30 along the length direction of the rotation axis 00. A side-opening door is used as an example. As shown in FIG. 1, the inner door 20 and the outer door 30 in the door structure are both side-opening doors, the rotation axis 00 thereof extends along the height direction of the door, and the first cover member 34*a* and the second cover member 34*b* are respectively located at the top and bottom of the outer door 30, and each may be used to shield a part of a hinge installed on the outer door 30.

Advantages of this solution are as follows: The front door panel extends out of the doorframe along the length or width direction and forms the protruding portion. The cover member is disposed behind each protruding portion. On one hand, the cover member can achieve an enhancing effect, to improve strength of the protruding portion and prevent the protruding portion from breaking. On the other hand, the cover member can achieve a covering effect, to cover some components, such as a hinge and a door handle, in the door structure. Therefore, structures of the inner door and the outer door may be more diversified, to ensure their functions, and at the time, meet an appearance requirement of industrial design.

In the embodiments shown in FIG. 1 and FIG. 2, the outer door 30 is articulated (i.e., pivotally, rotatably connected to) at the inner door 20 or the case body 10 by using hinges 41 and 42. A first end of each of the hinges 41 and 42 is connected to the outer door 30, and a second end is connected to the inner door 20, to limit the rotation axis 0-0 of the outer door 30. When the outer door 30 is a side-opening door, the hinge 41 is disposed at the top of the doorframe 31*b*, and the hinge 42 is disposed at the bottom of the doorframe 31*b*. The first cover member 34*a* may shield a part of the hinge 41, and the second cover member 34*b* may shield a part of the hinge 42.

The hinges 41 and 42 each include the first end that extends to an end surface of the doorframe 31*b*, and the first end may include a hinge shaft, to thread through a shaft hole of the doorframe 31*b*, thereby fixing the hinges 41 and 42 to the doorframe 31*b*. Along the length direction of the rotation axis 00, a projection of the first end coincides with a projection of the doorframe 31*b*. The first protruding portion 32*a* extends out of the top of the doorframe 31*b* along a direction of the rotation axis 00, the first end of the hinge 41 is located behind the first protruding portion 32*a*, and the first cover member 34*a* shields a part of or all of the first end of the hinge 41 at least on a side of the hinge 41 towards a door side surface. The second protruding portion 32*b* extends out of the bottom of the doorframe 31*b* along a direction of the rotation axis 00, the first end of the hinge 42 is located behind the second protruding portion 32*b*, and the second cover member 34*b* shields a part of or all of the first end of the hinge 42 at least on a side of the hinge 42 towards a door side surface.

The "door side surface" is a surface of a door that extends along a thickness direction of the door among outer surfaces of the door, that is, a surface that extends along the front-back direction of the door.

Figure 3:
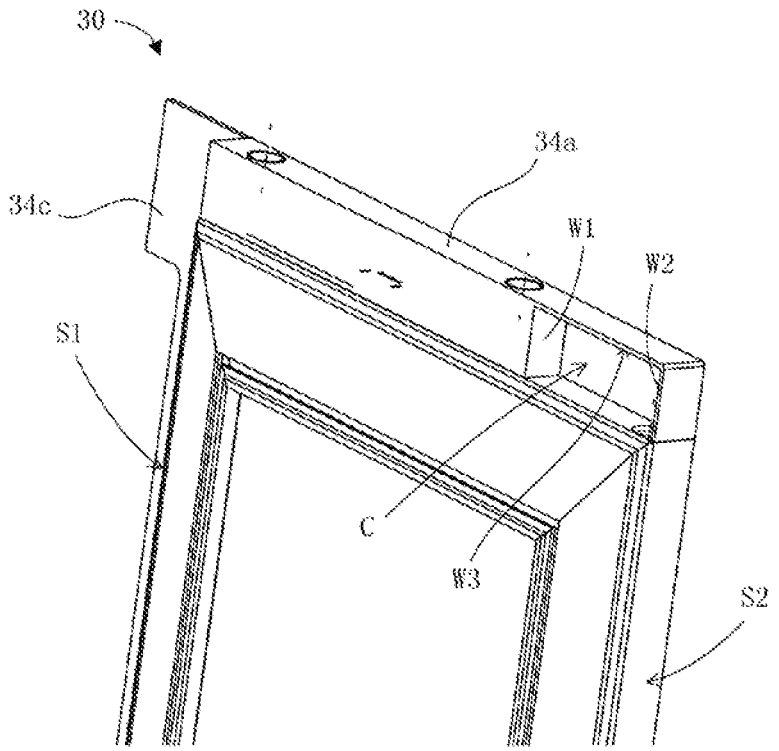
FIG. 3 is a three-dimensional schematic structural diagram of the top of an outer door of a household appliance according to an embodiment of the present invention.
Figure 4:
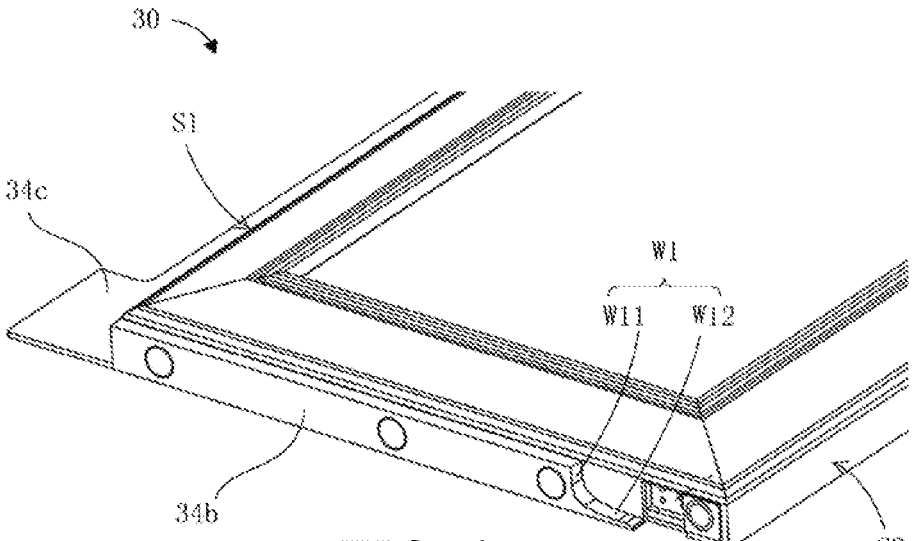
FIG. 4 is a three-dimensional schematic structural diagram of the bottom of an outer door of a household appliance according to an embodiment of the present invention.

As shown in FIG. 2 to FIG. 4, the doorframe 31*b* includes a first door side surface S1 and a second door side surface S2 opposite to each other that are arranged along a direction perpendicular to a length direction of the rotation axis 00, the second door side surface S2 is closer to the rotation axis 00 than the first door side surface S1, and the second door side surface S2 is located at a free end of the outer door 30. The first door side surface S1 and the second door side surface S2 are located two sides along a length direction of the first protruding portion 32*a* and the second protruding portion 32*b*. In addition, as shown in FIG. 3 and FIG. 4 (the front door panel is not shown in FIG. 3 and FIG. 4), the first cover member 34*a* and the second cover member 34*b* extend from the first door side surface S1 to the second door side surface S2 along a width direction of the door.

As shown in FIG. 3, an accommodating cavity C for accommodating the first end of the hinge 41 is formed behind the first protruding portion 32*a* at the top of the outer door 30, the first end of the hinge 41 extends into the accommodating cavity C, and a shaft hole at the top of the outer door 30 that is used for connecting to the hinge 41 is exposed in the accommodating cavity C. When the outer door 30 is open, an area that is occupied by the first end of the hinge 41 that extends into the accommodating cavity C is relatively small; and when the outer door 30 is closed, an area that is occupied by the first end of the hinge 41 that extends into the accommodating cavity C is relatively large. The accommodating cavity C may be directly formed in the first cover member 34*a*, or in some other embodiments, the accommodating cavity C may be jointly enclosed by the first cover member 34*a*, the doorframe 31*b*, and the first protruding portion 32*a*, or may be enclosed by the first cover member 34*a* and the first protruding portion 32*a*.

The accommodating cavity C of the first cover member 34*a* has a first shielding wall W1 towards the hinge 41, the first shielding wall W1 is located on a side of the hinge 41 towards the first door side surface S1, and the first shielding wall W1 is located between the first door side surface S1 and the rotation axis 00 along the width direction of the door. Along a direction from the first door side surface S1 to the second door side surface S2, the first end of the hinge 41 is shielded by the first shielding wall W1. Therefore, from the perspective of a free end of the outer door 30, the first end of the hinge 41 is shielded by the first shielding wall W1, to be hidden from the sight of a user.

The accommodating cavity C of the first cover member 34*a* further has a second shielding wall W2 towards the hinge 41, the second shielding wall W2 is located on a side of the hinge 41 towards the second door side surface S2, and the second shielding wall W2 is located between the second door side surface S2 and the rotation axis 00 along the width direction of the door. Along a direction from the second door side surface S2 to the first door side surface S1, the first end of the hinge 41 is shielded by the second shielding wall W2. Therefore, from the perspective of the rotation axis 00 of the outer door 30, the first end of the hinge 41 is shielded by the second shielding wall W2, to be hidden from the sight of the user.

It can be seen that, along the width direction of the door, the first end of the hinge 41 is located between the first shielding wall W1 and the second shielding wall W2, and is separately shielded by the first shielding wall W1 and the second shielding wall W2. Therefore, from the width direction of the door, the first end of the hinge 41 is hidden in the accommodating cavity C.

It should be understood that, to ensure the aesthetic of the outer door 30 on the first door side surface S1 and the second door side surface S2, a side of the first cover member 34*a* on the second door side surface S2 is flush with the second door side surface S2, and a side on the first door side surface S1 is flush with the first door side surface S1.

Further, the first cover member 34*a* further has a third shielding wall W3 towards the hinge 41, the third shielding wall W3 is located on a side of the hinge 41 opposite to the doorframe 31*b*, and the third shielding wall W3 serves as a top wall of the accommodating cavity C, to shield, at the top of the outer door 30, the first end of the hinge 41. Therefore, from the perspective of the top of the outer door 30, the first end of the hinge 41 is hidden behind the third shielding wall W3.

It can be seen that, along the height direction of the door, the first end of the hinge 41 is located between the third shielding wall W3 and the end surface of the doorframe 31*b*. Therefore, from the height direction of the door, the first end of the hinge 41 is hidden in the accommodating cavity C.

It should be understood that, to ensure the aesthetic of the outer door 30 at the top, the first cover member 34*a* and the first protruding portion 32*a* are flush with each other on a side opposite to the doorframe 31*b*, and a top surface of the first cover member 34*a* serves as a side surface at the top of the outer door.

The shape of the second cover member 34*b* of the outer door 30 that is located behind the second protruding portion 32*b* may be set by referring to that of the first cover member 34*a*. When the outer door 30 is a door that turns upwards or downwards, a structure of the second cover member 34*b* and a structure of the first cover member 34*a* are preferably set to be consistent with each other. Therefore, hinges on both sides can be effectively shielded.

In this embodiment, the second cover member 34*b* is disposed at the bottom of the outer door 30, and a probability for the hinge 42 at the bottom to be exposed to a visual field of the user is relatively small. Therefore, a structure of the second cover member 34*b* may be different from a structure of the first cover member 34*a*. As shown in FIG. 4, the second cover member 34*b* includes the first shielding wall W1, and the first shielding wall W1 is formed by an end surface of the second cover member 34*b*. The first shielding wall W1 includes two interconnected parts. The first part W11 extends along a thickness direction of the outer door 30, and the second part W12 extends along a direction from the first door side surface S1 to the second door side surface S2. Preferably, the first part W11 and the second part W12 have a smooth transition, that is, a connection corner between the two pars is round.

As shown in FIG. 4, in the second cover member 34*b*, there is no shielding wall for shielding the hinge 42 other than the first shielding wall W1.

Figure 5:
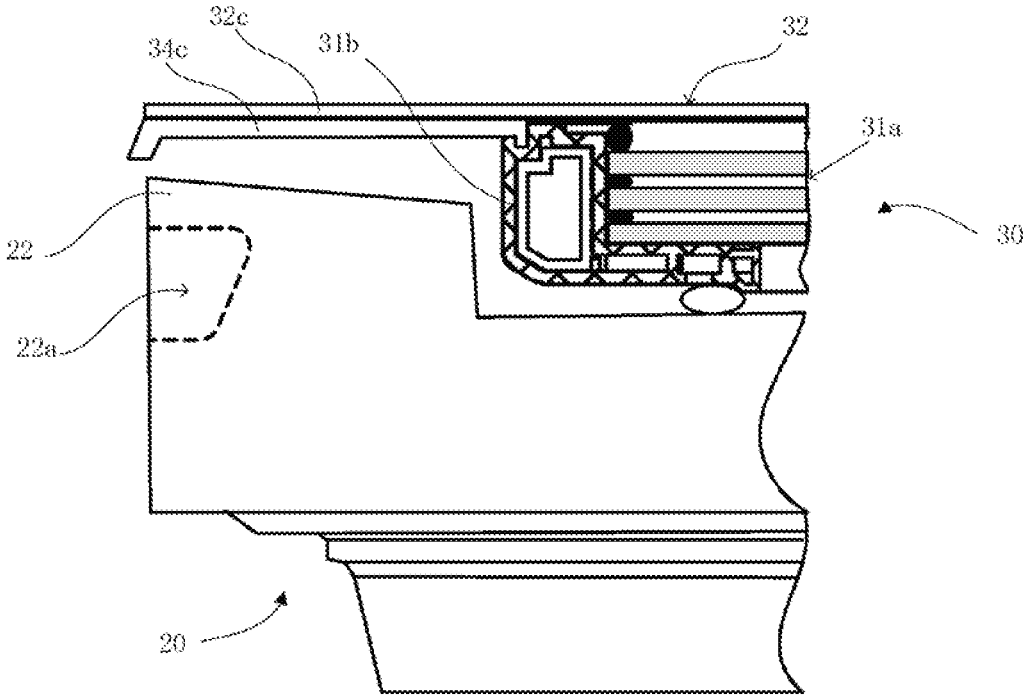
FIG. 5 is a schematic sectional diagram of an outer door and an inner door that are superposed and that are of a household appliance on a side of a third protruding portion according to an embodiment of the present invention.

As shown in FIG. 1 and with reference to FIG. 2 and FIG. 5, the third cover member 34*c* is disposed on a side of the outer door 30 away from the rotation axis 0-0 of the outer door 30. A handle portion 22 of the inner door is provided at the back of the third protruding portion 32*c*. In this embodiment, the third cover member 34*c* is a protective plate connected to a rear surface of the third protruding portion 32*c* to shield the rear surface, and there is a spacing between the handle portion 22 and the third protruding portion 32*c* along the front-back direction of the door, to prevent the handle portion 22 and the third cover member 34*c* from collision. The third cover member 34*c* is fixed to the doorframe 31*b*. Therefore, when the user applies force to the third cover member 34*c*, at least a part of the force may be shared by the doorframe 31*b*. Preferably, the third cover member 34*c* adheres to the rear surface of the third protruding portion 32*c*.

In some other embodiments, the third cover member may alternatively be a frame structure or another structure, and the handle portion of the outer door may be directly integrated into the third cover member.

It should be understood that, the structure of the outer door 30 may alternatively be used in a refrigerator with a single-layer door structure in which the inner door is omitted and the outer door 30 is directly connected to the case body by using the hinges 41 and 42.

In addition, the household appliance in this embodiment is not limited to a refrigerator, and may also be an electrical appliance, such as an oven, a microwave oven, or a disinfection cabinet, that has a storage space and is closed by using a door structure. The door structure may include only the outer door 30 or include both the inner door 20 and the outer door 30.

Although the present invention has been disclosed above, the present invention is not limited thereto. Any person skilled in the art may make various variations or modifications without departing from the spirit and the scope of the present invention. Therefore, the protection scope of the present invention shall be subject to the scope of the claims.

The invention claimed is:

1. A household appliance, comprising:

a case body and a door rotatably mounted about a rotation axis relative to said case body;

said door including a doorframe defining door side surfaces of said door and a heat insulation module disposed in said doorframe, said doorframe having a front side and a front door panel being a plate mounted on the front side of said doorframe and covering said heat insulation module;

said front door panel having a protruding portion that extends out of said doorframe along a length or width direction of said door;

a hinge for defining the rotation axis, said hinge having a first end disposed on an end surface of said doorframe; and said door having a cover member disposed behind said protruding portion, said cover member having a cavity defined by walls of said cover member, said walls shielding at least three sides of said hinge.

2. The household appliance according to claim 1, wherein said cover member is affixed to at least one of said front door panel or said doorframe.

3. The household appliance according to claim 1, wherein said protruding portion extends out of said doorframe along a direction of the rotation axis, said hinge has a first end disposed behind said protruding portion, and said cover member shields the first end at least on a side of said hinge towards a door side surface.

4. The household appliance according to claim 3, wherein:

said door side surfaces of said door include a first door side surface and a second door side surface opposite one another and arranged along a direction parallel to a length direction of the rotation axis and perpendicular to said front door panel;

said second door side surface is closer to the rotation axis than said first door side surface; and said cover member has a first shielding wall towards said hinge, and said first shielding wall is disposed on a side of said hinge towards said first door side surface.

5. The household appliance according to claim 4, wherein said first shielding wall is formed by an end surface of said cover member.

6. The household appliance according to claim 5, wherein said first shielding wall comprises a first part and a second part connected to one another, said first part extends along a thickness direction of the door, and said second part extends along a direction from said first door side surface to said second door side surface.

7. The household appliance according to claim 6, wherein said first and second parts have a smooth transition.

8. The household appliance according to claim 3, wherein:

said door side surfaces of said door include a first door side surface and a second door side surface opposite one another and arranged along a direction parallel to a length direction of the rotation axis and perpendicular to said front door panel;

said second door side surface is closer to the rotation axis than said first door side surface; and said cover member has a shielding wall towards said hinge, and said shielding wall is disposed on a side of said hinge towards said second door side surface.

9. The household appliance according to claim 8, wherein said shielding wall is flush with said second door side surface.

10. The household appliance according to claim 3, wherein said cover member and said protruding portion are flush with each other on a side opposite said doorframe.

11. The household appliance according to claim 3, wherein said first end of said hinge is fixed to said doorframe.

12. The household appliance according to claim 1, wherein said cover member adheres to a rear side of said protruding portion.

13. The household appliance according to claim 1, wherein said doorframe comprises first and second door side surfaces located on two sides along a length direction of said protruding portion, and said cover member extends from said first door side surface to said second door side surface.

14. The household appliance according to claim 1, wherein:

said cover member is provided with a handle portion; or a handle portion is provided at the back of said protruding portion, and said cover member is located between said handle portion and said protruding portion.

15. The household appliance according to claim 1, wherein said cover member is a protective plate connected to a rear surface of said protruding portion to shield the rear surface.

16. The household appliance according to claim 1, wherein said doorframe comprises at least one border having a heat-insulation cavity inside, and said front door panel is connected to a front side of the at least one border.

17. The household appliance according to claim 16, wherein the at least one border is an extrusion member.

18. The household appliance according to claim 1, wherein said front door panel is a glass plate.

19. The household appliance according to claim 1, wherein said heat-insulation module is a heat-insulation glass module.

20. The household appliance according to claim 1, further comprising an inner door rotatably connected to said case body, wherein said door is rotatable relative to said inner door.

21. A household appliance, comprising:

a case body and a door rotatably mounted about a rotation axis relative to said case body;

said door including a doorframe defining door side surfaces of said door and a heat insulation module disposed in said doorframe, said doorframe having a front side and a front door panel being a plate mounted on the front side of said doorframe and covering said heat insulation module;

said front door panel having a protruding portion that extends out of said doorframe along a length or width direction of said door; and said door having a cover member disposed behind said protruding portion;

a hinge for defining the rotation axis, said hinge having a first end disposed on an end surface of said doorframe;

said protruding portion extending out of said doorframe along a direction of the rotation axis, said hinge having a first end disposed behind said protruding portion, and said cover member shielding the first end at least on a side of said hinge towards a door side surface; and said cover member has a shielding wall towards said hinge, and said shielding wall is disposed on a side of said hinge opposite said doorframe.

22. A household appliance, comprising:

a case body and a door rotatably mounted about a rotation axis relative to said case body;

said door including a doorframe having a front side, door side surfaces, and a front door panel connected to the front side of said doorframe;

said front door panel being a glass plate having a protruding portion extending out of said doorframe and laterally outward from said door side surfaces;

a hinge for defining the rotation axis, said hinge having a first end disposed on an end surface of said doorframe; and said door having a cover member disposed behind said protruding portion and projecting outward from said doorframe and laterally outward from said door side surfaces along a length direction of said door, said cover member having a cavity defined by walls of said cover member, said walls shielding at least three sides of said hinge.

* * * * *